United States Patent [19]

Clubb et al.

[11] Patent Number: 4,971,230

[45] Date of Patent: Nov. 20, 1990

[54] CONTAINER FOR LIQUIDS

[75] Inventors: David C. Clubb, Kent; Michael Hanff, Middlesex, both of England

[73] Assignee: The British Petroleum Company p.l.c., London, England

[21] Appl. No.: 360,919

[22] PCT Filed: Sep. 8, 1988

[86] PCT No.: PCT/GB88/00735

§ 371 Date: May 23, 1989

§ 102(e) Date: May 23, 1989

[87] PCT Pub. No.: WO89/02856

PCT Pub. Date: Apr. 6, 1989

[30] Foreign Application Priority Data

Sep. 24, 1987 [GB] United Kingdom ..... 8722511

[51] Int. Cl.[5] ..... B65D 25/44

[52] U.S. Cl. ..... 222/468; 222/479; 222/538

[58] Field of Search ..... 222/465.1, 468, 478–479, 222/525–526, 538, 569; 215/1 C; 220/85 SP

[56] References Cited

U.S. PATENT DOCUMENTS

| | | | |
|---|---|---|---|
| 2,040,545 | 5/1936 | Byers | 222/488 |
| 2,898,014 | 8/1959 | Borah | 222/481.5 |
| 2,992,761 | 7/1961 | Sommers, Sr. | 222/479 |
| 3,235,146 | 2/1966 | Parish et al. | 222/478 |
| 3,372,846 | 3/1968 | Berkus | 222/479 |
| 4,295,583 | 10/1981 | Schurr | 222/478 |
| 4,311,259 | 1/1982 | Babiol | 222/525 |

FOREIGN PATENT DOCUMENTS

| | | |
|---|---|---|
| 0224863 | 6/1987 | European Pat. Off. . |
| 87/01677 | 3/1987 | World Int. Prop. O. . |

*Primary Examiner*—Michael S. Huppert

*Attorney, Agent, or Firm*—L. W. Evans; Joseph G. Curatolo; Scott A. McCollister

[57] ABSTRACT

Container (11) for liquids has a spout with an air bleed channel (10) for improving the ease of pouring the liquids. The container has a retractable nozzle, the outlet end of which has a double wall (3,4) defining an annular space. The annular space is open at both ends and communicates with the air bleed channel in both an extended and a retracted position of the nozzle. The air bleed channel communicates with the main body of the container via its hollow handle.

4 Claims, 3 Drawing Sheets

CONTAINER FOR LIQUIDS

This invention relates to a container from which liquids, or free flowing solids, may be poured. It relates particularly to a container for dispensing relatively small quantities of liquids by hand e.g. containers for lubricating oils or liquid detergents.

As liquid is poured, air must come in to replace the liquid and if the air is not admitted in a controlled fashion the pouring can become erratic, with the liquid coming out in surges and slugs. Various proposals have been made to control the admission of air and prevent surging. An air vent separate from the pouring spout is one solution, but since the container has to be liquid tight its air vent has to be sealable separately from the spout.

Other solutions involve admitting the air through the pouring spout but controlling the liquid flow so that there is always air space above the liquid stream being poured. These solutions normally involve the spout having some form of neck below the spout outlet and a channel below the spout but above the neck directing the air into the free space in the container. Examples of this are shown in U.S. Pat. No. 4412633, GB Patent Application No. 2098572A and PCT Application No. 87/01677.

Some liquid containers also have a retractable nozzle fitting within the spout which can be pulled out to assist pouring and pushed back in after use. One embodiment described in PCT Application 87/01677 has such a retractable nozzle. In this embodiment, any liquid flowing down the outside of the nozzle collects in a well above the neck of the spout and can return into the container via the air bleed.

However, with the air bleed-retractable nozzle design liquid flowing down the outside of the nozzle is not the only, or necessarily the most pressing problem. If the container is not held vertically the liquid may bleed through the handle and dribble from the end of the container instead of through the nozzle.

The present invention is concerned with an improved retractable nozzle for a container for liquids which obviates this difficulty with sideways pouring.

According to the present invention a retractable nozzle for a container for liquids having a spout with an air-bleed is characterised in that the outlet end of the nozzle has a double wall enclosing an annular space, the annular space being open at both ends so that fluid flow can occur through the space from the air bleed.

The nozzle can be held retractably within the spout in any convenient known way. The double wall of the nozzle should not extend down the whole length of the nozzle but should extend down at least the length of the portion extending beyond the spout when in the pouring position. The outside diameter of the double walled portion of the nozzle may be slightly larger than the single-walled portion so that there is a gap between the inside of the spout and the outside of the single-walled portion of the nozzle, this gap providing a passage for air from the annular space to the air bleed channel.

The air inlet end of the annular space can simply be flush with the liquid outlet end of the nozzle. At the other end, the annular space can communicate with the gap and the air bleed channel by two or more holes in the base of the outside wall.

The outside wall of the double wall may have a projection on its outside near the base as a form of seal with the inside of the spout, so that any liquid flowing down the outside of the nozzle does not enter the gap and air bleed channel.

The present invention includes a container for liquids having a retractable nozzle as described above.

The invention is illustrated by the accompanying drawings in which:

BRIEF DESCRIPTION OF THE DRAWINGS

In Figure 1, the nozzle is generally cylindrical. At its top it is double walled with inside wall 3 and outside wall 4. The annular space enclosed by the walls is open at the top. Below the double-walled portion of the nozzle is a portion with a single wall 6. The top of this wall 6 seals the bottom of the annular space but there are outlets 7 in the base of the outside wall 4 so that the annular space is, in effect, open at both ends. There may be any convenient number of outlets, preferably four.

The diameter of the single wall 6 is slightly less than that of the double-walled portion. At the bottom of the single wall are barbs 8 designed to hold the nozzle within the spout of a container.

Figure 1A:
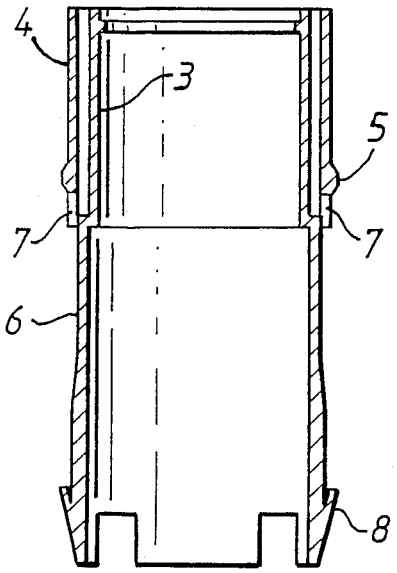
FIGS. 1A and 1B are, respectively, a section through and a view of a nozzle according to the present invention.
Figure 1B:
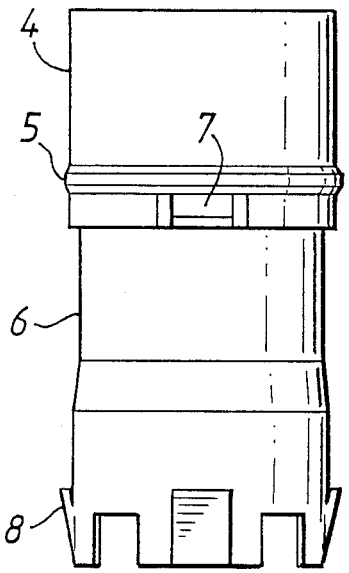
Figure 2A:
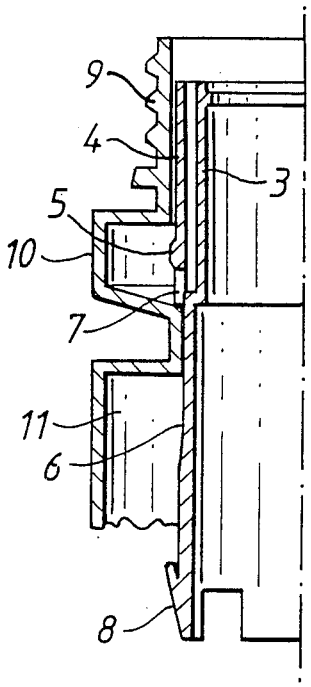
FIGS. 2A and 2B show the nozzle of FIG. 1 in place in the spout of a container in, respectively, the retracted and extended positions.
Figure 2B:
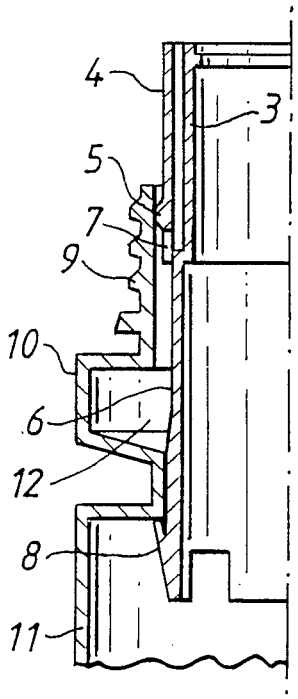
Figure 3:
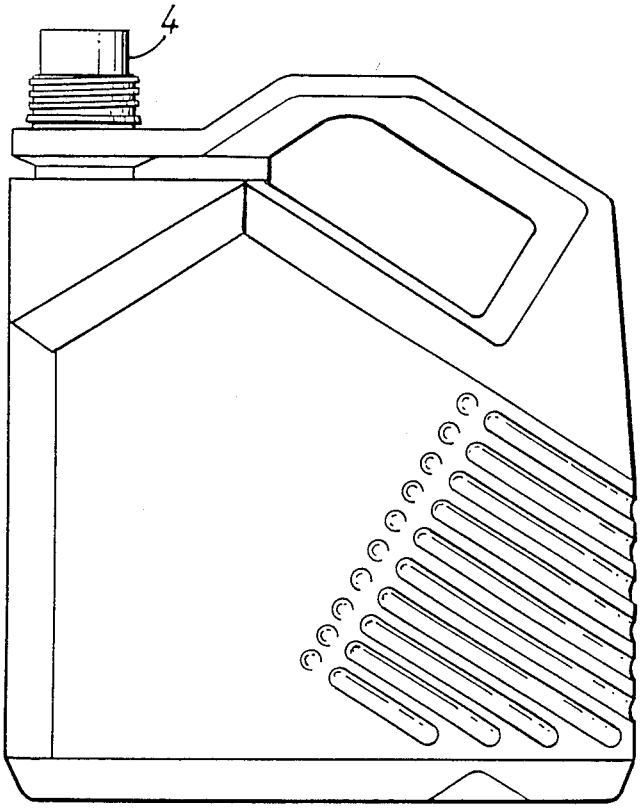
FIG. 3 shows a perspective view of a container with handle having a retractable nozzle.

In FIG. 2, the spout of a container has a screw-threaded top portion 9 to hold a cap, and a projecting portion 10 forming an air bleed channel. The spout extends from the main body 11 of the container. FIG. 2 shows how the nozzle is held within the spout. In the retracted position of FIG. 2A the downward movement of the nozzle is limited by the base of the double-walled portion abutting against the base of the air bleed channel projection 10. In the extended position- of FIG. 2B, barbs 8 limit the upward movement of the nozzle by abutting against the main body 11 of the container.

The nozzle and the container may be made of any suitable material, e.g. plastic or metal, and if the nozzle material is slightly flexible, the nozzle can simply be inserted during manufacture by pressure to force the barbs through the spout.

FIG. 2B shows that, with the nozzle in the extended position, there is an air passage through the annular space, through outlets 7, and through the gap 12 between the spout and the single-walled portion 6 of the nozzle to the air-bleed channel 10. Channel 10 can communicate with the main body of the container in any convenient way, e.g. through a hollow handle of the container.

Exterior projection 5 on the double-walled portion of the nozzle abuts against the inside of spout 9 when the nozzle is extended so that any liquid flowing down the outside of the nozzle does not enter the air bleed channel.

Even if the container is held so that liquid is poured out of the nozzle with a sideways component, the air passage formed by the annular space will not be totally blocked by liquid, so that air can enter the container and prevent any surging of the liquid stream.

We claim:

1. A container for a liquid comprising in combination;

(a) a thin walled chamber for containing the liquid, the chamber also having a hollow carrying handle;

(b) the thin walled chamber having an opening for dispensing the liquid;

(c) a retractable nozzle adapted to pass retractably and sealingly through the opening;

(d) the opening having a projecting portion adapted to co-operate with the retractable nozzle to form an annular air bleed channel;

(e) the air bleed channel being in communication with the hollow carrying handle; and (f) the retractable nozzle comprising an upper portion in the form of a cylinder having a double wall defining an annular space therebetween and a lower portion having means limiting the movement of the retractable nozzle through the opening, the annular space being open at each end and in communication with the annular bleed channel, whereby, during pouring of liquid from the container, entry of air is permitted into the chamber thereby allowing a controlled liquid flow.

2. A container for a liquid according to claim 1 wherein the double wall of the nozzle has a circumferential projection in sealing contact with the nozzle when the nozzle is in its extended position.

3. A container for a liquid according to claim 1 in which the means for limiting the movement of the retractable nozzle through the opening comprises at least one retaining barb.

4. A container for a liquid according to claim 1 wherein the annular air bleed channel communicates wit the annular space between the double wall of the cylinder by means of at least one outlet hole in the cylinder.

* * * * *